United States Patent [19]

Benigni

[11] Patent Number: 4,818,912

[45] Date of Patent: Apr. 4, 1989

[54] CRT WITH ARC SUPPRESSING MEANS ON INSULATING SUPPORT RODS

[75] Inventor: Samuel P. Benigni, Lititz, Pa.

[73] Assignee: RCA Licensing Corporation, Princeton, N.J.

[21] Appl. No.: 168,200

[22] Filed: Mar. 15, 1988

[51] Int. Cl.[4] ..... H01J 29/82; H01J 29/50

[52] U.S. Cl. ..... 313/457; 313/479

[58] Field of Search ..... 313/457, 479, 417

[56] References Cited

U.S. PATENT DOCUMENTS

| | | | |
|---|---|---|---|
| 4,214,798 | 7/1980 | Hopen | 316/26 |
| 4,288,719 | 9/1981 | Hernqvist | 313/457 |
| 4,403,547 | 9/1983 | Forberger | 101/170 |
| 4,503,357 | 3/1985 | Ouhata et al. | 313/457 X |
| 4,567,400 | 1/1986 | Opresko | 313/457 |

*Primary Examiner*—Palmer C. DeMeo

*Attorney, Agent, or Firm*—Eugene M. Whitacre; Dennis H. Irlbeck; Vincent J. Coughlin, Jr.

[57] ABSTRACT

The novel CRT has an electron gun mount assembly therein which is similar in construction to prior CRT's. The electron gun mount assembly includes a cathode for generating at least one electron beam and a plurality of successively spaced electrodes including a screen grid electrode, a focusing electrode and an anode electrode secured to one major surface of at least two longitudinally extending insulating support beads. A first gap of predetermined width extends between the anode electrode and one end of the focusing electrode. A second gap of predetermined width extends between the opposite end of the focusing electrode and the screen grid electrode. An opposite major surface of each of the support beads faces outwardly and has thereon an electrically-conducting coating having a longitudinal dimension, d. Suitable voltages are applied to the electrodes to generate electrical activity. The coating on each of the beads is spaced a distance $1.25 \times d$ from the end of the focusing electrode adjacent to the second gap.

9 Claims, 2 Drawing Sheets

CRT WITH ARC SUPPRESSING MEANS ON INSULATING SUPPORT RODS

BACKGROUND OF THE INVENTION

The invention relates to a novel CRT (cathode-ray tube) comprising a beaded electron gun mount assembly disposed in a glass neck of the tube in which the insulating support beads of the electron gun carry electrically-conductive coatings for suppressing arcing therein; and more particularly for suppressing flashovers in the neck of the CRT. The electrically-conductive coatings are of a size and are located so as to permit electrical processing of the tube without adverse effects.

A color television picture tube is a CRT which comprises an evacuated glass envelope including a viewing window which carries a luminescent viewing screen, and a glass neck which houses an electron gun mount assembly for producing one or more electron beams for selectively scanning the viewing screen. Each gun comprises a cathode and a plurality of electrodes supported as a unit in spaced tandem relation from at least two elongated, longitudinally-oriented support rods, which are usually in the form of glass beads. The beads have extended surfaces closely spaced from and facing the inner surface of the glass neck. The beads usually extend from the region close to the stem, where the ambient electric fields are small, to the region of the electrode to which the highest operating potential is applied, where the ambient electric fields are high during the operation of the tube. The spaces between the beads and the neck surfaces are channels in which leakage currents may travel from the stem region up to the region of the highest-potential electrode. These leakage currents are associated with blue glow in the neck glass, with charging of the neck surface and with arcing or flashover in the neck.

Several expedients have been suggested for blocking or reducing these leakage currents. Coatings on the neck glass are partially effective to prevent arcing but are burned through when arcing does occur. A metal wire or ribbon in the channel (partially or completely around the mount assembly) is also partially effective to reduce arcing because it is often bypassed due to its limited longitudinal extent, because the limited space between the bead and the neck may result in shorting problems, and because there is frequently field emission from the metal structure.

One other expedient which has been found to be particularly effective is disclosed in U.S. Pat. No. 4,288,719 to K. G. Hernqvist issued Sept. 8, 1981. The Hernqvist patent discloses a CRT including a beaded electron-gun mount assembly in which each glass bead has a rectangularly-shaped electrically-conductive metal coating on the bead surface facing the neck. It has been found, however, that when the electrodes of the electron gun are electrically processed; e.g., by spot-knocking,the electrically-conductive coatings are eroded, producing undesirable particles in the CRT. Spot-knocking is described in U.S. Pat. No. 4,214,798 to Hopen issued on July 29, 1980.

Yet another expedient which has been effective is described in U.S. Pat. No. 4,567,400 to S. A. Opresko issued Jan. 28, 1986. The Opresko patent discloses that the electrically-conductive coatings should be positioned opposite a focusing electrode and spaced a prescribed distance away from a gap between the end or anode electrode and the adjacnet focusing electrode.

Additionally, no portion of the electrically-conductive coatings should be opposite a claw on the focusing electrode. However, the coatings described in the Opresko patent adversely affect not only the degree of spot-knocking activity, i.e., the number of induced electrical discharges but also the region of the electron gun mount assembly in which the discharges take place. In particular, the electrical activity during the spot-knocking process is typically seven times higher for CRT's with the electrically-conductive coatings on the insulating beads than for CRT's without the coatings. This high degree of electrical activity is known to generate bead, stem, and glass-neck particles which may cause blocked apertures in the shadow mask of the tube. In addition, the prior electrically-conducting coatings concentrate the spot-knocking activity in the low voltage region of the mount assembly. Thus, the spot-knocking activity in the high voltage region of the mount (between the anode electrode and the focusing electrode) is reduced and the subsequent high voltage characteristics, i.e., leakage currents and afterglow are not optimized.

SUMMARY OF THE INVENTION

The novel CRT having the electron gun mount assembly therein is similar in construction to the prior CRT's disclosed in the Hernqvist and Opresko patents. Like the prior structures, the present electron gun mount assembly comprises means for generating at least one electron beam and a plurality of successively spaced-apart electrodes including a screen grid electrode, a focusing electrode and an anode electrode secured to one major surface of at least two longitudinally-extending insulating support beads. An opposite major surface of each of the support beads faces outwardly and has thereon an electrically-conducting coating located opposite the focusing electrode. Means are provided for applying suitable voltages to the electrodes to generate electrical activity within said electron gun mount assembly and along the beads thereof. The present structure differs from the prior structures in that the electrically-conducting coating on each of the beads is located in an area of minimum electrical activity along the beads and is spaced a predetermined distance from the end of the focusing electrode adjacent to the screen grid electrode

DETAILED DESCRIPTION OF THE PREFERRED EMBODIMENT

Figure 2:
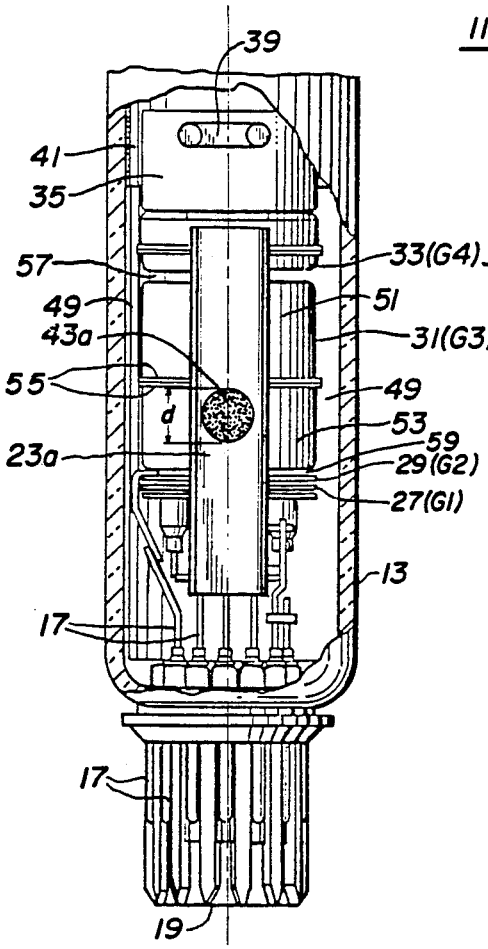
FIG. 2 is a broken-away, front, elevational view along section line 2—2 of the neck of a CRT shown in FIG. 1.
Figure 1:
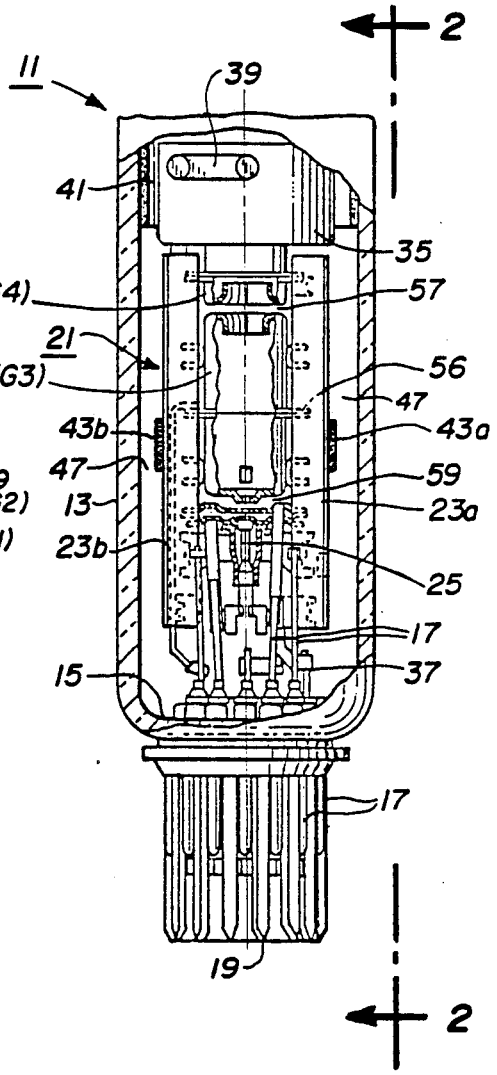
FIG. 1 is a broken-away, side, elevational view of the neck of a preferred CRT according to the invention.

FIGS. 1 and 2 show structural details of the neck of a color television picture tube. The structure of this CRT is conventional except for the electron-gun mount assembly. The structural details thereof are similar to those described in the aforementioned U.S. Pat. No. 4,288,719 which is incorporated by references herein for the purpose of disclosure. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base 19 is attached to the pins 17 outside the envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly comprises two glass support rods or beads 23*a* and 23*b* to which the various electrodes are secured and supported to form a coherent unit in a manner commonly used in the art. These electrodes include three substantially equally transversely spaced coplanar cathodes 25 (one for producing each beam), a control-grid electrode (also referred to as $G_1$) 27, a screen grid electrode (also referred to as $G_2$) 29, a focusing electrode (also referred to as $G_3$) 31, an anode electrode (also referred to as $G_4$) 33, and a shield cup 35, longitudinally spaced in that order by the beads 23*a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with an electrically-conducting internal coating 41 on the inside surface of the neck 13. The internal coating 41 extends over the inside surface of the funnel and connects to the anode button (not shown).

Each of the beads 23*a* and 23*b* is about 10 mm (millimeters) wide by 50 mm long and carries an electrically-conducting coating 43*a* and 43*b*, respectively, on a portion of its surface facing and spaced from the inside surface of the neck 13. In this example, each coating 43*a* and 43*b* is a metal resinate such as Hanovia Liquid Bright Platinum No. 5, which is marketed by Englehard Industries, Inc., East Newark, N.J. A resinate coating may be produced by any of the known processes, such as painting, screening, spraying or by print transfer. The resinate-coated beads are then heated to 500° C. in air to volatilize organic matter and to cure the coating and then are cooled to room temperature. In this embodiment, the product is a coating comprising an alloy of platinum and gold that is tightly bonded to the outwardly facing surface of each of the beads 23*a* and 23*b*. Each coating 43*a* and 43*b* is substantially circular and has a diameter, d, of about 6.4 mm ($\frac{1}{4}$ inch), which is less than the full width of the bead. Each coating is about 1000 Å thick except at the edges where it is tapered to a thickness of about 500 Å. Each coating is floating electrically.

The tube may be operated in its normal way by applying operating voltages to the pins 17 and to the internal coating 41 through the anode button; which, for example, are typically less than 100 volts on $G_1$, about 600 volts on $G_2$, about 8,000 volts on $G_3$ and about 30,000 volts on $G_4$. Because of the beaded structure described, the regions between the beads and the neck, which can be called the bead channels 47, behave differently than the regions between the neck and the other parts of the mount assembly, which can be called the gun channels 49. Arcing (flashover), when it occurs, occurs in the bead channels 47, when the tube is operating and the conducting coatings 43*a* and 43*b* are absent. However, with the conductive coatings present, as shown in FIGS. 1 and 2, arcing in these channels is substantially entirely suppressed.

The G3 or focusing electrode 31 comprises a first substantially rectangular, tub-shaped cup 51 disposed towards the G4 or anode electrode 33 and a second substantially rectangular, tub-shaped cup 53 disposed towards the G2, which cups are joined together at their open ends by means of peripheral flanges 55 which include claws 56 for securing the cups 51 and 53 to the beads 23*a* and 23*b*. A first gap 57 having a gap width of about 1.25±0.20 mm (50±8 mils) is formed between the end of the first cup 51 and the G4. A second gap 59 extends between the opposite end of the second cup 53 and the G2. The second gap 59 has a gap width of about 0.85±0.05 mm (33±2 mils).

The embodiment shown in FIGS. 1 and 2 is distinguished from the embodiments to the Hernqvist and Opresko patents, op. cit., in that the center of the conducting coating 43*a* and 43*b* is spaced a predetermined distance of about 1.25 times the longitudinal dimension, d, from the end of the second cup 53 of the focusing electrode 31 adjacent to the second gap 59.

Preferably, the conducting coatings 43*a* and 43*b* are circular so that no pointed corners are available to initiate electrical arcing or to generate particles. It has been determined that a coating diameter of about 6.4 mm ($\frac{1}{4}$ inch) is ideal since that is smaller than the width (10 mm) of the support beads 23*a* and 23*b* thus making the conducting coatings 43*a* and 43*b* independent of the location of the claws 56. As herein described, the coatings 43*a* and 43*b* are centered about 0.31 inch (8 mm) from the end of the second cup 53 adjacent to the second gap 59.

Figure 3:
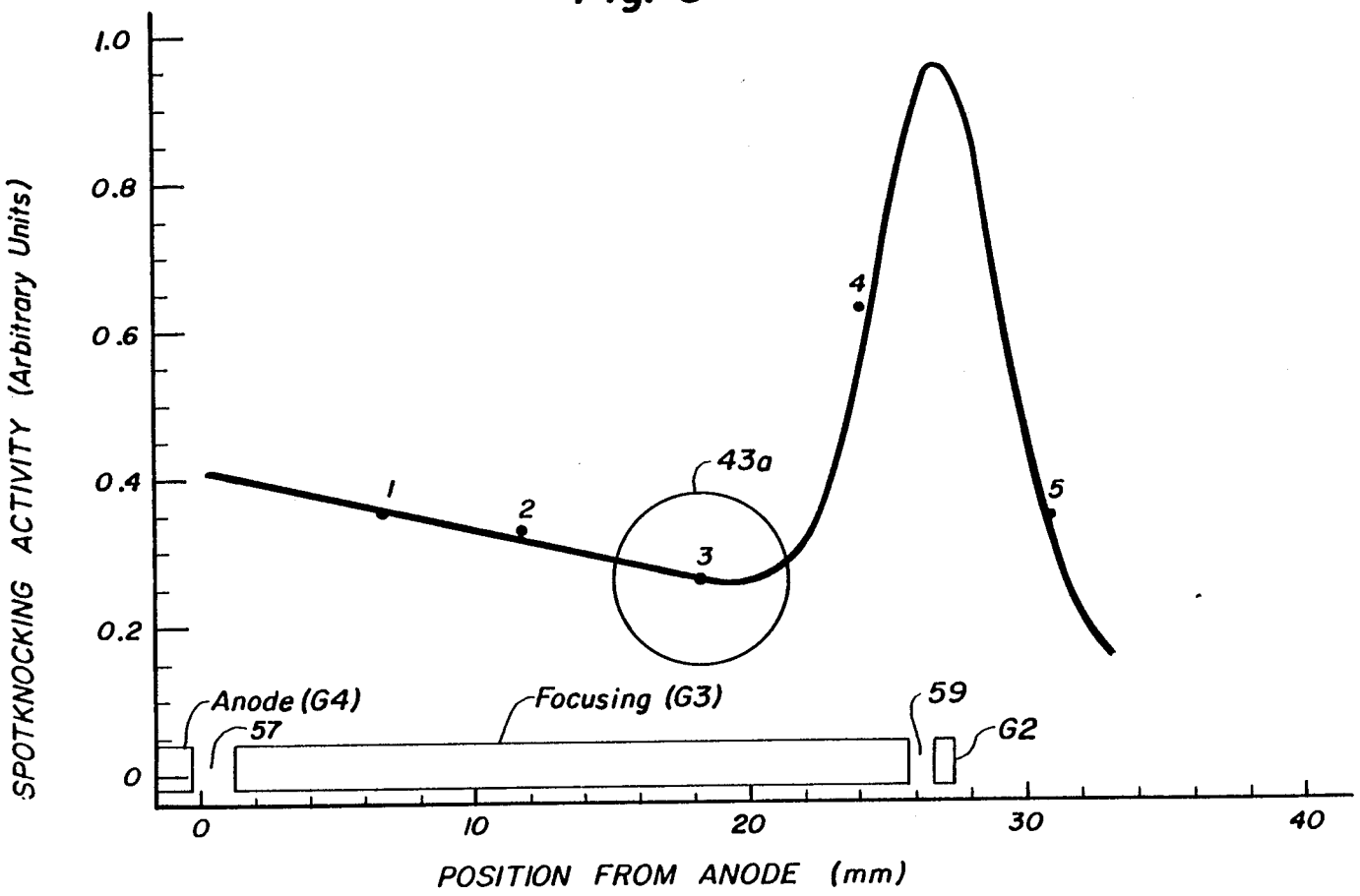
FIG. 3 is a curve showing the relative spotknocking activity along a portion of the electron gun.

FIG. 3 is a curve showing the relative spotknocking activity for a conducting coating 43*a*, 43*b* located at various positions along the beads 23*a*, 23*b*. The beads themselves are not shown; however, the relative locations of the anode electrode (G4), focusing electrode G3 and screen grid electrode G2 are shown to scale. The curve has been normalized so that at the peak of spotknocking activity a value of 1 has been assigned. One of the conducting coating 43*a* is shown superposed on the curve at the area of minimum spotknocking activity.

The spotknocking is performed in the manner described in U.S. Pat. No. 4,214,798 issued to L. Hopen on July 29, 1980 which is incorporated by reference herein for the purpose of disclosure. Briefly, the electron gun mount assembly elements comprising a heater, a cathode, a control electrode and a screen electrode are interconnected and spotknocking voltages in excess of normal operating voltages are applied between an anode and the interconnected gun elements. A focusing electrode is electrically floating during spotknocking. The spotknocking removes from the surface of the electrodes projections, burrs and/or particles which would later be sites for the field emission of electrons during the normal operation of the CRT.

The size and location of the conducting coatings 43*a*, 43*b* strongly influence both the level of spotknocking activity and its effectiveness. Reduction in the level of spotknocking activity is advantageous since a high activity level can damage the tube and create loose particles. The optimum position for the present conducting coatings 43*a*, 43*b*, on the beads 23*a*, 23*b* is shown in FIG. 3 as centered around data point 3. The curve suggests that spotknocking activity can be minimized by locating the conducting coatings 43*a*, 43*b* on the outwardly facing major surface of the beads 23a, 23b, over the focusing electrode, G3, so that the coatings are in an area of minimum electrical activity. The experimental data points, comparing relative spotknocking activity for a conductive coating having a diameter of ¼ inch as a function of the distance that the center of the coatings is located from the anode electrode, G4, are listed in Table I. It should be noted that in the vicinity of the gap 59 between the G2 and G3 electrodes, i.e., between data points 4 and 5, the electrical activity and the possibility of particle generation and/or electrical damage to the electron gun is greatest. This is in agreement with observations of the spotknocking results on CRT's made using large area conducting coatings such as those shown in FIGS. 1 and 2 of the Opresko patent, op. cit.

The spotknocking activity curve of FIG. 3 was constructed by counting the arcs generated during spotknocking, visually determining the location of the arcs and by evaluating the post-spotknocking performance of the processed CRT's.

TABLE I

| DATA POINT | DISTANCE FROM G4 (MM) | SPOTKNOCKING ACTIVITY |
|---|---|---|
| 1 | 6.6 | 0.35 |
| 2 | 11.7 | 0.32 |
| 3 | 18.0 | 0.25 |
| 4 | 23.9 | 0.62 |
| 5 | 30.7 | 0.34 |

Table II compares the spotknocking activity of different size conductive coatings (including uncoated support beads 23a and 23b) but with the location of the coating fixed at a distance of 12.7 mm from G4. Sample sizes ranged from 20 to 550 tubes. The "standard" conducting coatings are substantially rectangular in shape and have an area normalized to 1. The present circular conducting coatings have a normalized area of 0.3.

TABLE II

| Coating Type | Normalized Area | Normalized Spotknocking Activity | Focus Leakage (≧1 μA. @ 40 kV) | Afterglow (@ <40 kV) |
|---|---|---|---|---|
| Standard | 1 | 1 | 78% | 85% |
| Circular | 0.3 | 0.44 | 43% | 49% |
| None | 0 | 0.17 | — | |

While CRT's having electron guns without conducting coatings showed very low spotknocking activity, it is known from the work of Hernqvist, as disclosed in U.S. Pat. No. 4,288,719, op. cit., that some type of conducting coating is required on the support beads of the electron gun mount assembly to suppress arcing and flashover during normal tube operation. The effectiveness of the present circular conducting coating compared to the prior standard coating was confirmed by analyzing the CRT's used to provide the information in Table II. The present circular conducting coatings 43a, 43b, provided a lower percentage of CRT's having focus leakage of equal to or greater than one microampere at an anode voltage of 40 kilovolts and a lower percentage of tubes exhibiting afterglow at an anode voltage of less than about 40 kilovolts than did CRT's using a standard conducting coating of the type similar to that disclosed in the above-referenced Hernqvist and Opresko patents. Afterglow is electron emission from the G3–G4 region of the electron gun which manifests itself as a visual pattern on the screen after the CRT is turned off but before the stored charge can dissipate. The reduced size and novel position of the present conducting coatings 43a, 43b, show that, in general, spotknocking is more effective with the present coating than with the prior conducting coating, and that tube performance, as measured by a decrease in leakage current and afterglow, is significantly improved.

What is claimed is:

1. In a cathode-ray tube having a glass neck and an electron gun mount assembly in said neck, said mount assembly comprising means for generating at least one electron beam and a plurality of successively spaced-apart electrodes including a screen grid electrode, a focusing electrode and an anode electrode secured to one major surface of at least two longitudinally extending insulating support beads, an opposite major surface of each of said beads being outwardly facing and having thereon an electrically-conductive coating located opposite said focusing electrode, and means for applying suitable voltages to said electrodes to generate electrical activity within said electron gun mount assembly and along said beads thereof, wherein the improvement comprises said coating on each of said beads being located in an area of minimum electrical activity along said beads, said coating being spaced a predetermined distance from an end of said focusing electrode adjacent to said screen grid electrode.

2. The cathode-ray tube defined in claim 1, wherein said conductive coating has a longitudinal dimension, d, and the center of said coating is spaced about 1.25 times the longitudinal dimension, d, of said coating from said end of said focusing electrode.

3. The cathode-ray tube defined in claim 2, wherein said conductive coating has a circular shape.

4. The cathode-ray tube defined in claim 3, wherein said dimension, d, of said coating is about ¼ inch (6.4 mm).

5. The cathode-ray tube defined in claim 3, wherein said coating is electrically floating.

6. In a cathode-ray tube having a glass neck and an electron gun mount assembly in said neck, said mount assembly comprising means for generating at least one electron beam and a plurality of successively spaced-apart electrodes including a screen grid electrode, a focusing electrode and an anode electrode secured to one major surface of at least two longitudinally-extending insulating support beads, a first gap of predetermined width extending between said anode electrode and one end of said focusing electrode and, a second gap of electrode, an predetermined width extending between the opposite end of said focusing electrode and said screen grid electrode, an opposite major surface of each of said beads being outwardly facing and having thereon an electrically-conducting coating located opposite said focusing electrode, said coating having a longitudinal dimension, d, and means for applying suitable voltages to said electrodes to generate electrical activity within said electron gun mount assembly and along said beads thereof, said electrical activity along said beads initially decreasing with increasing distance from said first gap and then abruptly increasing in the vicinity of said second gap, wherein the improvement comprises said coating on each of said beads being located in an area of minimum electrical activity along said beads the center of said coating being spaced about 1.25 times the longitudinal dimension, d, of said coating from the end of said focus electrode adjacent to said second gap.

7. The cathode-ray tube defined in claim 6, wherein said conductive coating has a circular shape.

8. The cathode-ray tube defined in claim 7, wherein said dimension, d, of said coating is about $\frac{1}{4}$ inch (6.4 mm).

9. The cathode-ray tube defined in claim 7, wherein said coating is electrically floating.

* * * * *

UNITED STATES PATENT AND TRADEMARK OFFICE
CERTIFICATE OF CORRECTION

PATENT NO. : 4,818,912

DATED : April 4, 1989

INVENTOR(S) : Samuel P. Benigni

It is certified that error appears in the above-identified patent and that said Letters Patent is hereby corrected as shown below:

Col. 4, line 15, change "0.85" to --0.84--.

Col. 6, line 52 after "of", delete "electrode, an".

Signed and Sealed this

Twelfth Day of September, 1989

*Attest:*

DONALD J. QUIGG

*Attesting Officer*

*Commissioner of Patents and Trademarks*